US007789466B2

(12) United States Patent
Yoda et al.

(10) Patent No.: US 7,789,466 B2
(45) Date of Patent: Sep. 7, 2010

(54) CHAIR-TYPE MASSAGE MACHINE

(75) Inventors: Yuki Yoda, Saitama (JP); Koji Terada, Hikone (JP); Shinji Tsutsui, Hikone (JP); Nobuyuki Nishitani, Kusatsu (JP); Yoshimi Takahashi, Inukami (JP); Taichi Hamatsuka, Kyoto (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 11/984,910

(22) Filed: Nov. 26, 2007

(65) Prior Publication Data

US 2008/0122283 A1 May 29, 2008

(30) Foreign Application Priority Data

Nov. 27, 2006 (JP) ..... 2006-319240

(51) Int. Cl.
*A47C 7/50* (2006.01)

(52) U.S. Cl. ..... 297/423.35

(58) Field of Classification Search ..... 297/84, 297/423.35, 423.34, 217.3; 601/49, 98
See application file for complete search history.

(56) References Cited

U.S. PATENT DOCUMENTS 2,918,964 A * 12/1959 Braun ..... 297/423.32
4,678,229 A * 7/1987 Ryan et al. ..... 297/68
4,819,987 A * 4/1989 Stringer ..... 297/423.35
4,919,478 A * 4/1990 Tacker ..... 297/85 R
5,056,864 A * 10/1991 Cooper ..... 297/188.21
5,352,020 A * 10/1994 Wade et al. ..... 297/423.26
5,411,468 A * 5/1995 Chen ..... 601/57
5,813,727 A * 9/1998 Sugawa et al. ..... 297/411.42
6,053,880 A * 4/2000 Sleichter, III ..... 601/57
6,065,806 A * 5/2000 Miyaguchi et al. ..... 297/362.13
6,076,893 A * 6/2000 Brotherston ..... 297/423.35
6,652,033 B2 * 11/2003 Satoh ..... 297/423.3
6,695,406 B2 * 2/2004 Plant ..... 297/423.26
7,069,608 B2 * 7/2006 Failor et al. ..... 5/618
7,293,839 B2 * 11/2007 Shimizu ..... 297/423.36
2002/0113477 A1 * 8/2002 Uchiyama ..... 297/330
2003/0139693 A1 * 7/2003 Swift ..... 601/15
2005/0033204 A1 * 2/2005 Nakamura et al. ..... 601/103
2006/0235340 A1 * 10/2006 Gibson ..... 601/15
2006/0241536 A1 * 10/2006 Yoda et al. ..... 601/98
2006/0249992 A1 * 11/2006 LaPointe et al. ..... 297/68
2007/0024101 A1 * 2/2007 Hsieh ..... 297/423.19
2007/0257530 A1 * 11/2007 Florez et al. ..... 297/217.4
2008/0149770 A1 * 6/2008 Hoffjann et al. ..... 244/122 R
2008/0197677 A1 * 8/2008 Nivet ..... 297/68

* cited by examiner

*Primary Examiner*—David Dunn
*Assistant Examiner*—Tania Abraham
(74) *Attorney, Agent, or Firm*—Bacon & Thomas, PLLC

(57) ABSTRACT

A chair-type massage machine includes a seat on which a user sits; a leg rest whose one end portion is pivotally connected with a front portion of the seat for pivotal movement up and down, the leg rest supporting calves of the user; a driving unit for pivotally moving the leg rest with respect to the seat; a footrest pivotally connected with the other end portion of the leg rest for pivotal movement up and down, the footrest supporting feet of the user; and a massage means provided to at least one of the leg rest and the footrest. Also, a stopper unit is provided for restricting a pivotal movement range of the footrest with respect to the leg rest, and a biasing unit is disposed for applying a biasing force to the footrest in either an upward or downward a direction of the pivotal movement.

15 Claims, 7 Drawing Sheets

CHAIR-TYPE MASSAGE MACHINE

FIELD OF THE INVENTION

The present invention relates to a chair-type massage machine having a footrest part.

BACKGROUND OF THE INVENTION

As for a conventional chair-type massage machine, there has been known one including a seat on which a user sits, a leg rest pivotally connected with a front side of the seat and a footrest pivotally connected with a front side of the leg rest. The leg rest and the footrest are provided with respective massage means such as airbags or the like. The massage can be performed by the massage means in a state where user's calves and feet ranging from ankles to toes and soles are respectively held by the leg rest and the footrest.

As for a connection structure between the leg rest and the footrest in the above massage machine, Japanese Patent Laid-open Application No. H10-295753 discloses therein a structure in which surfaces of the leg rest with which user's calves mainly contact (hereafter, referred to as "calves supporting surfaces") are fixed in substantially perpendicular to surfaces of the footrest with which feet of the user ranging from ankles to toes and soles contact (hereinafter, referred to as "feet supporting surfaces"). However, if the leg rest and the footrest are fixed as a unit, user's ankles are constantly held at a specific angle, which disturbs the relaxation of the user.

To that end, Japanese Patent Laid-open Application No. 2003-310682 suggests therein a structure in which the footrest is pivotally connected to the leg rest through a link mechanism for pivotal movement up and down with respect to the leg rest. In this structure, the footrest is maintained in a horizontal posture at all times regardless of a pivotal movement of the leg rest. Further, when the leg rest is driven to a substantially horizontal position, the leg rest and the footrest are aligned substantially in line with each other. In that state, the user puts rear sides of ankles on the feet supporting surfaces of the footrest, thus performing the massage thereon.

However, in the above massage machine, an angle between the leg rest and the footrest is determined by a posture of the leg rest and, thus, is hardly changeable by a user. If the user puts soles on the feet supporting surfaces of the footrest after the leg rest is driven to the substantially horizontal position, the user's posture becomes uncomfortable. Further, calves and soles cannot be massaged at the same time while stretching both legs forward.

SUMMARY OF THE INVENTION

The present invention provides a chair-type massage machine capable of easily changing an angle of a footrest with respect to a leg rest regardless of a posture of the leg rest and also capable of easily switching a massage by the footrest between a massage for soles and a massage for rear sides of ankles.

In accordance with one aspect of the present invention, there is provided a chair-type massage machine including: a seat on which a user sits; a leg rest whose one end portion is pivotally connected with a front portion of the seat for pivotal movement up and down, the leg rest supporting calves of the user; a driving unit for pivotally moving the leg rest with respect to the seat; a footrest pivotally connected with the other end portion of the leg rest for pivotal movement up and down, the footrest supporting feet of the user; a massage means provided to at least one of the leg rest and the footrest; a stopper unit for restricting a range of the pivotal movement of the footrest with respect to the leg rest; and a biasing unit for applying a biasing force to the footrest in either an upward or downward direction of the pivotal movement.

In the above chair-type massage machine (hereinafter, referred to as "first chair-type massage machine"), the user can easily change the angle of the footrest with respect to the leg rest regardless of the posture of the leg rest by pressing toe sides or heel sides. Accordingly, the massage by the footrest 8 can be easily switched between a massage for soles and a massage for rear sides of ankles. Besides, the stopper unit is provided to prevent a user from falling down due to sudden excessive movement. Further, the biasing unit is provided, so that the footrest can automatically return to the original position when load is removed, which makes the manipulation simple. Further, the generation of vibration or noise occurred from various massage mechanism is effectively suppressed.

In accordance with another aspect of the present invention, there is provided a chair-type massage machine including: a seat on which a user sits; a leg rest whose one end portion is pivotally connected with a front portion of the seat for pivotal movement up and down, the leg rest supporting calves of the user; a driving unit for pivotally moving the leg rest with respect to the seat; a footrest pivotally connected with the other end portion of the leg rest for pivotal movement up and down, the footrest supporting feet of the user; a massage means provided to at least one of the leg rest and the footrest; a stopper unit for restricting a range of the pivotal movement of the footrest with respect to the leg rest, wherein a pivot axis about which the footrest is pivotally moved with respect to the leg rest is positioned to face the feet supporting surfaces of the footrest on which soles of the user are put.

In the above chair-type massage machine (hereinafter, referred to as "second chair-type massage machine"), the user can easily change the angle of the footrest with respect to the leg rest about an pivot axis regardless of the posture of the leg rest by pressing toe sides or heel sides. Thus, the massage by the footrest can be easily switched between the massage for soles and the massage for rear sides of ankles. Further, a stopper unit is provided to prevent a user from making a misstep due to sudden excessive movement.

In the second chair-type massage machine, it is preferable that the pivot axis about which the footrest is pivotally moved with respect to the leg rest is substantially aligned with an axis extending between ankle joints of the user who puts soles on the feet supporting surfaces. Accordingly, the soles are kept in place on the feet supporting surfaces even when the footrest is pivotally moved, thereby allowing the user to feel comfortable in manipulating the footrest. Further, the massage position is kept unchanged, so that the effective massage can be performed.

Further, in the second chair-type massage machine, it is preferable that a positioning unit for determining position of the user's feet on the footrest is provided. Therefore, the feet of the user and the pivot axis of the footrest can be kept in a stable position, and the user can pivotally move the footrest in a stable manner.

Further, in the second chair-type massage machine, it is preferable that a biasing unit for applying a biasing force to the footrest in either an upward or a downward direction of the pivotal movement. As a consequence, when the load of user's feet are removed, the footrest automatically returns to the original position, which makes the manipulation simple. Further, the generation of vibration or noise occurred from various massage mechanism is effectively suppressed.

In the first and the second chair-type massage machine, it is preferable that the biasing unit applies a biasing force in a direction of pivotally moving a leading side of the footrest upward. Therefore, in order to move the footrest, it is preferable to press tiptoes downward. The operation of pressing tiptoes downward is easier than an operation of pressing heels downward in consideration of the structure of the human body. Further, the operation of pressing tiptoes downward is generally performed when pressing an accelerator pedal of a car or the like. In other words, the footrest can pivotally moved with the simple operation.

Further, it is preferable that the biasing unit reduces the biasing force in the direction of a pivotal movement as the leading side of the footrest pivotally moved downward with respect to the leg rest. In general, the pressing force of tiptoes increases as an angle between feet and calves becomes close to 90° and decreases as the tiptoes are gradually stretched downward therefrom. For that reason, the user can easily move the footrest. When the massage is performed in a state where the footrest has been pivotally moved to the lowermost position, the biasing force of pivotally moving the footrest upward is minimized. As a result, the ankles are not highly pressed.

Further, it is preferable that the biasing unit reverses the direction of the biasing force when the leading side of the footrest is pivotally moved downward beyond a specific angle. Therefore, the user can easily move the footrest downward. Moreover, when the massage is performed in a state where the footrest has been pivotally moved to the lowermost position, the biasing force of pivotally moving the footrest upward is not applied; hence, the ankles are not highly pressed.

Further, it is preferable that the biasing unit is disposed at a central portion in a width direction of the footrest. As a consequence, the biasing force can be uniformly applied to both sides. Moreover, the biasing unit is installed in a dead space provided at a central portion of the footrest, so that miniaturization and cost reduction can be realized.

In the first and the second chair-type massage machine, it is preferable that a damping mechanism for restricting a speed of pivotal movement of the footrest with respect to the leg rest is provided. Accordingly, it is possible to reduce noise and vibration generated when the pivotal movement of the footrest is stopped by the stopper piece. Especially, by restricting the speed of the pivotal movement in the direction of pushing downward the leading side of the footrest, the user standing on the footrest can be prevented from falling down due to sudden movement of the footrest.

In the first and the second chair-type massage machine, it is further preferable that in a state that the leading side of the footrest is pivotally moved to contact with a bottom surface, the pivot axis about which the footrest is pivotally moved with respect to the leg rest is positioned, when seen from a side, below a straight line L connecting a contact point of the footrest with the bottom surface and another pivot axis about which the leg rest is pivotally moved with respect to the seat. Therefore, when the leg rest is pivotally moved downward, it is possible to prevent the leading end of the footrest from sticking into the bottom surface, which may results in poor movement or breakdown of the leg rest.

The present invention can provide a massage machine capable of easily changing an angle of the footrest to a desired angle relative to the leg rest regardless of a posture of the leg rest and easily switching a massage by the footrest between a massage for soles and a massage for rear sides of ankles.

BRIEF DESCRIPTION OF THE DRAWINGS

The objects and features of the present invention will become apparent from the following description of embodiments, given in conjunction with the accompanying drawings, in which:

FIGS. 2A and 2B illustrates a side view of the inner structure of the principal parts of the chair-type massage machine in accordance with the first embodiment of the present invention, wherein FIG. 2A shows a state where a footrest is pivotally moved to an uppermost position, and FIG. 2B depicts a state where the footrest is pivotally moved to a lowermost position;

FIGS. 3A to 3C describes the chair-type massage machine in accordance with the first embodiment of the present invention, wherein FIG. 3A is a perspective view, FIG. 3B is a side view of a state where the footrest is pivotally moved to the uppermost position, and FIG. 3C is a side view of a state where the footrest is pivotally moved to the lowermost position;

FIGS. 4A and 4B presents a side view of an inner structure of principal parts of a chair-type massage machine in accordance with a second embodiment of the present invention, wherein FIG. 4A shows a state where a footrest is pivotally moved to an uppermost position, and FIG. 4B depicts a state where the footrest is pivotally moved to a lowermost position;

FIGS. 7A and 7B represents a side view of an inner structure of principal parts of a chair-type massage machine in accordance with a fifth embodiment of the present invention, wherein FIG. 7A shows a state where a leg rest is pivotally moved downward until a footrest contacts with a bottom surface and FIG. 7B illustrates a state where the leg rest is pivotally moved to a lowermost position.

DETAILED DESCRIPTION OF THE EMBODIMENT

Figure 1:
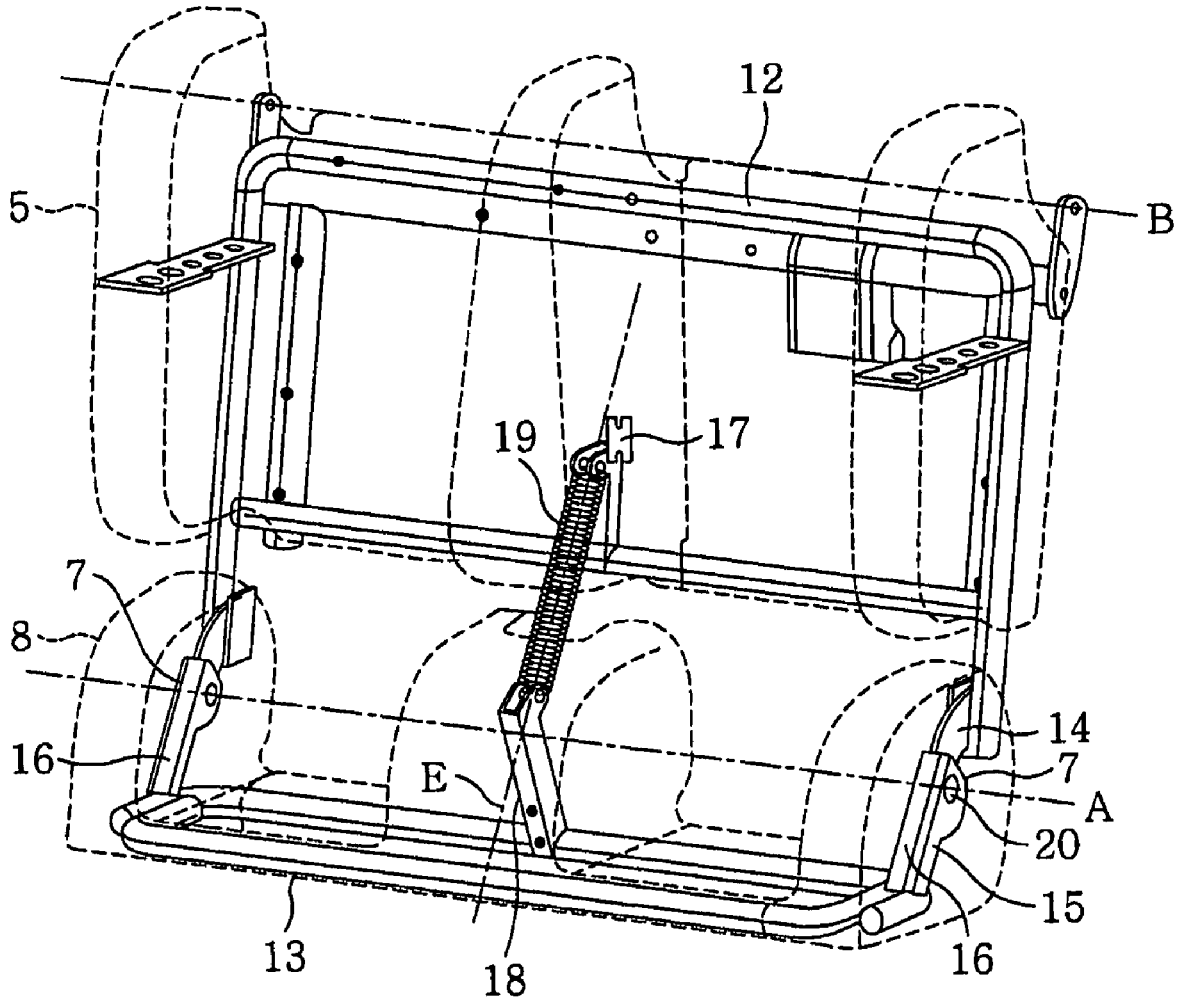
FIG. 1 is a perspective view showing an inner structure of principal parts of a chair-type massage machine in accordance with a first embodiment of the present invention.

Hereinafter, the embodiments of the present invention will be described in detail with reference to the accompanying drawings. FIGS. 3A to 3C describe a chair-type massage machine in accordance with a first embodiment of the present invention as a whole. The chair-type massage machine of the first embodiment, which is installed on a bottom surface F, includes a seat 1 having a seat surface 1*a* on which a user sits; a pair of armrest 2 installed at both sides of the seat 1; a backrest 3, for supporting a back of a user, being connected to a rear side of the seat 1 for pivotal movement forward and backward; a leg rest 5 whose one end is pivotally connected to a front side of the seat 1 via a support bar 4 for pivotal movement up and down; a driving unit 6 for driving the movement of the leg rest 5 with respect to the seat 1; and a footrest 8 pivotally connected to the other end of the leg rest 5 (opposite to the end connected with the support bar 4) for pivotal movement up and down via a pair of connecting supports 7 (see FIGS. 1, 2A and 2B).

The directions (forward/backward, right/left and upward/downward) used in this specification are determined based on a user sitting on the seat 1. With respect to the seat 1, the side where the leg rest 5 is positioned is a front side, whereas the side where the backrest 3 is positioned is a rear side. Further, with respect to the leg rest 5 and the footrest 8, the up and down movement thereof means that the leading side thereof, opposite to the side serving as the pivot axis, pivotally moves up and down.

The leg rest 5 has a pair of recess portions 9 for inserting and supporting user's right and left calves, and inner bottom surfaces of the recess portions 9 serve as calves supporting surfaces 5*a* with which the calves contact. Further, the footrest 8 has a pair of recess portions 10 for inserting and supporting user's right and left feet, and inner bottom surfaces of the recess portions 10 serve as feet supporting surfaces 8*a* to be in contact with soles or the like. In this embodiment, massage means 11 having airbags are provided on right/left inner side surfaces of the recess portions 9 of the leg rest 5, right/left inner side surfaces and inner bottom surfaces (i.e., the feet supporting surfaces 8*a*) of the recess portions 10 of the footrest 8. However, the massage means 11 may be provided at least either at the leg rest 5 or at the footrest 8.

The driving unit 6 includes a link mechanism driven by a motor (not shown) accommodated under the seat surface 1*a* of the seat 1. When the leg rest 5 is pivotally moved in a direction that the leading side thereof is moved downward by the link mechanism in response to an instruction from a manipulation unit (not shown), the seat surface 1*a* becomes substantially perpendicular to the calves supporting surfaces 5*a*, as illustrated in FIGS. 3A and 3B. When the leg rest 5 is pivotally moved in a direction that the leading side thereof is moved upward by the link mechanism, the seat surface 1*a* becomes substantially parallel to the calves supporting surfaces 5*a* as shown in FIG. 3C.

Figure 2A:
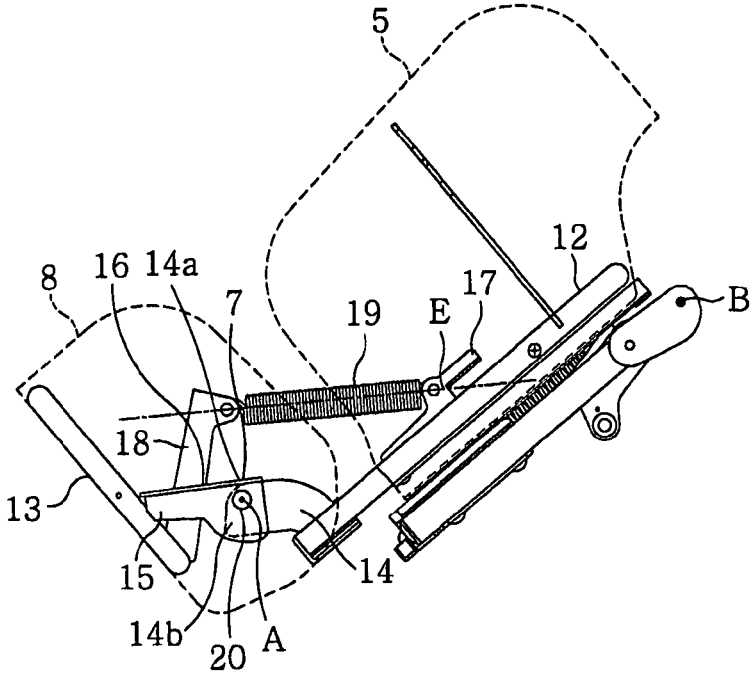
Figure 2B:
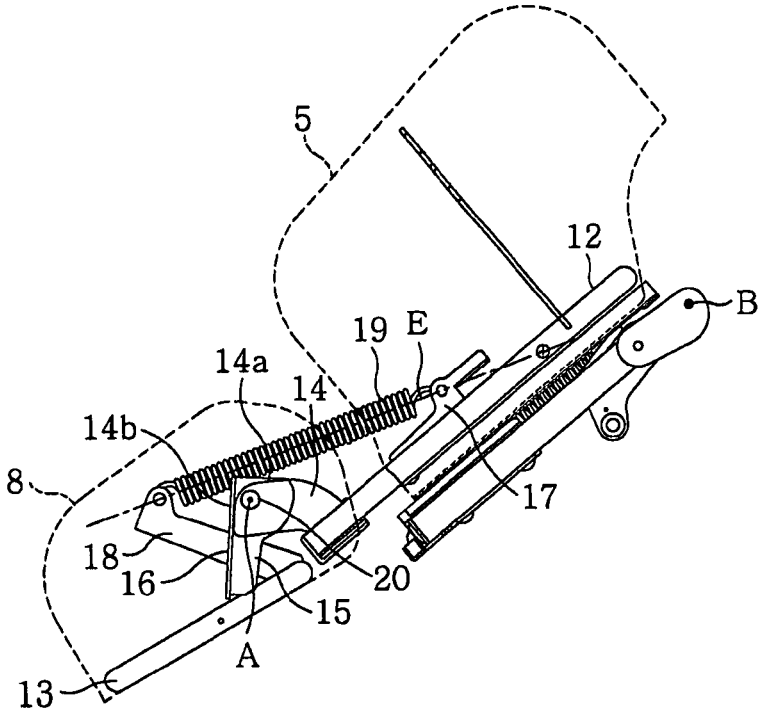
Figure 3A:
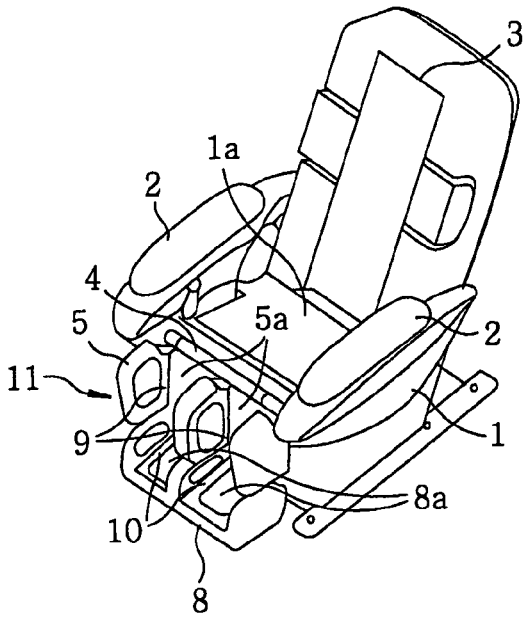
Figure 3B:
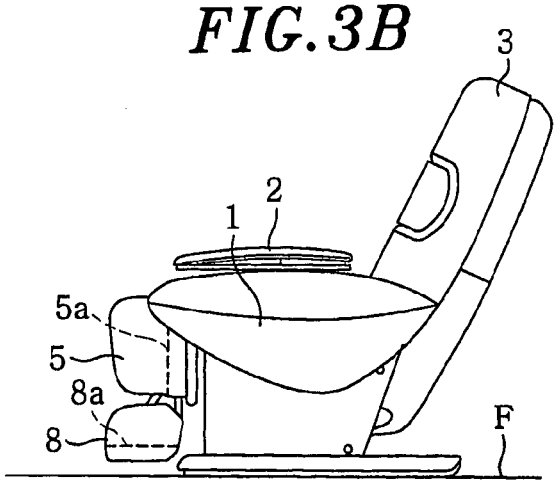
Figure 3C:
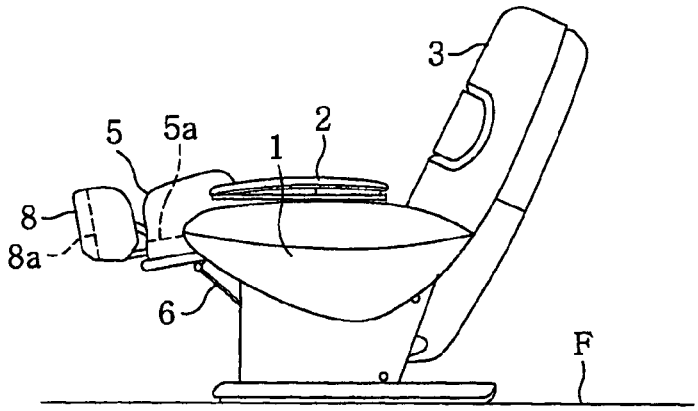

FIGS. 1, 2A and 2B show inner structures of the leg rest 5 and the footrest 8. A leg frame 12 accommodated in the leg rest 5 is pivotally connected with a foot frame 13 accommodated in the footrest 8 via the pair of connecting supports 7. Each of the connecting supports 7 includes a leg-side connecting member 14 fixed to the leg frame 12, a foot-side connecting member 15 fixed to the foot frame 13 and a shaft member 20 for pivotally connecting both connecting members 14 and 15. The foot-side connecting member 15 is formed as a unit with a flat plate shaped stopper piece 16 serving as a stopper unit for restricting a pivotal movement range of the footrest 8 with respect to the leg rest 5 by the contact with the leg-side connecting member 14.

In the leg-side connecting member 14, a first contacting surface 14*a* and a second contacting surface 14*b* are form a round corner of about 90°. As shown in FIG. 2A, the first contacting surface 14*a* contacts with the stopper piece 16 in a state where the feet supporting surfaces 8*a* and the calves supporting surfaces 5*a* are substantially perpendicular to each other. Moreover, as illustrated in FIG. 2B, the second contacting surface 14*b* contacts with the stopper piece 16 in a state where the feet supporting surfaces 8*a* and the calves supporting surfaces 5*a* are substantially parallel to each other. The angle (i.e., about 90°) formed by the first and the second contacting surface 14*a* and 14*b* is an angular range of the pivotal movement of the footrest 8.

A coil-shaped biasing spring 19 is installed between a spring anchor 17 provided at a center in a width direction (i.e., right/left direction) of the leg frame 12 and a spring anchor 18 provided at a center in the width direction of the foot frame 13. The footrest 8 is pivotally moved about a horizontal pivot axis A extending between the shaft members 20 of the right and the left connecting supports 7. However, the biasing spring 19 installed between the footrest 8 and the leg rest 5 (i.e., a tensile axis E of the biasing spring 19) is positioned above the pivot axis A when seen from the side, and applies a biasing force to the footrest 8 in a direction of pulling upward the leading side thereof.

Further, the coil-shaped biasing spring 19 is installed in a tensed state such that it can be extended within the pivotal movement range of the footrest 8. The tensile axis E of the biasing spring 19 is always positioned above the pivot axis A, and the biasing force is applied to the footrest 8 at all times in the direction of pulling upward the leading side of the footrest 8 by the tension generated along the tensile axis E. In this case, as the footrest 8 is pivotally moved downward with respect to the leg rest 5, the biasing spring 19, i.e., the tensile axis E, approaches the pivot axis A, and the biasing force applied in the direction of the pivotal movement decreases.

In the above-configured chair-type massage machine, a user sitting on the seat 1 inserts both legs into the respective recess portions 9 of the leg rest 5 provided at the front side of the seat 1 so that the calves contact with the calves supporting surfaces 5*a*, and also inserts both feet into the respective recess portions 10 of the footrest 8 so that the soles contact with the feet supporting surfaces 8*a*. When the user presses the footrest 8 with the tiptoes against the biasing force which is applied to the footrest 8, the footrest 8 is pivotally moved downward such that the leading side thereof moves down. By decreasing the pressing force, the footrest 8 is pivotally moved upward such that the leading side thereof moves up. In other words, the angle of the footrest 8 can be easily changed by just controlling the pressing force of the tiptoes and, also, the soles and the calves can be simultaneously massaged by the massage means 11 in a comfortable state. Moreover, since the pivotal movement range of the footrest 8 is restricted by the stopper piece 16, it is possible to prevent an excessive movement.

Even when the seat surface 1*a* and the calves supporting surfaces 5*a* are oriented substantially parallel to each other as depicted in FIG. 3C, if the position of the footrest 8 pivotally moved upward is maintained without pressing the footrest 8 with the tiptoes, the calves and the feet of the user can be massaged respectively by the massage means 11 of the leg rest 5 and the footrest 8 while stretching both legs. Meanwhile, if the user presses the footrest 8 with the tiptoes to pivotally move the footrest 8 downward to the lowermost position and maintains the posture of the footrest 8, the calves of the user can be massaged by the massage means 11 of the leg rest 5 and, also, the rear sides of the ankles contacting with the feet supporting surfaces 8*a* of the footrest 8 can be massaged while stretching both legs.

In general, the pressing force of tiptoes increases as an angle between feet and calves becomes close to 90° and decreases as the tiptoes are gradually stretched downward therefrom. In this embodiment, the biasing spring 19 is installed such that the biasing force in the pivotal movement direction decreases as the leading side of the footrest 8 is pivotally moved downward with respect to the leg rest 5. Therefore, the user can easily move the footrest 8. When the massage is performed on the range from the calves to the heels of the user while the rear sides of the ankles are put on the feet supporting surfaces 8*a* in a state where the footrest 8 has been pivotally moved to the lowermost position, the biasing force of pivotally moving the footrest 8 upward is minimized. As a result, the ankles are not highly pressed, and the user can feel comfortable.

In this embodiment, by positioning the tensile axis E of the biasing spring 19 above the pivot axis A, the biasing force is applied to the footrest 8 in the pivotal movement direction of pulling the leading side thereof upward. However, it is also possible to apply the biasing force to the footrest 8 in a pivotal movement direction of pulling the leading side thereof downward by positioning the tensile axis E of the biasing spring 19 under the pivot axis A. In that case, the user can change the angle of the footrest 8 by pressing the footrest 8 with the heel sides against the biasing force.

Hereinafter, a chair-type massage machine in accordance with a second embodiment of the present invention will be described with reference to FIGS. 4A and 4B. A description of the same configuration as that in the first embodiment will be omitted, and features of the second embodiment will be explained in detail hereinafter. In the second embodiment, the attachment positions of the biasing spring 19 are located closer to the calves supporting surfaces 5*a* and the feet supporting surfaces 8*a* such that the biasing spring 19 is installed closer to the pivot axis A in comparison with that in the first embodiment. Accordingly, if the footrest 8 is pivotally moved downward with respect to the leg rest 5 beyond a specific angle, the biasing direction is reversed.

Figure 4A:
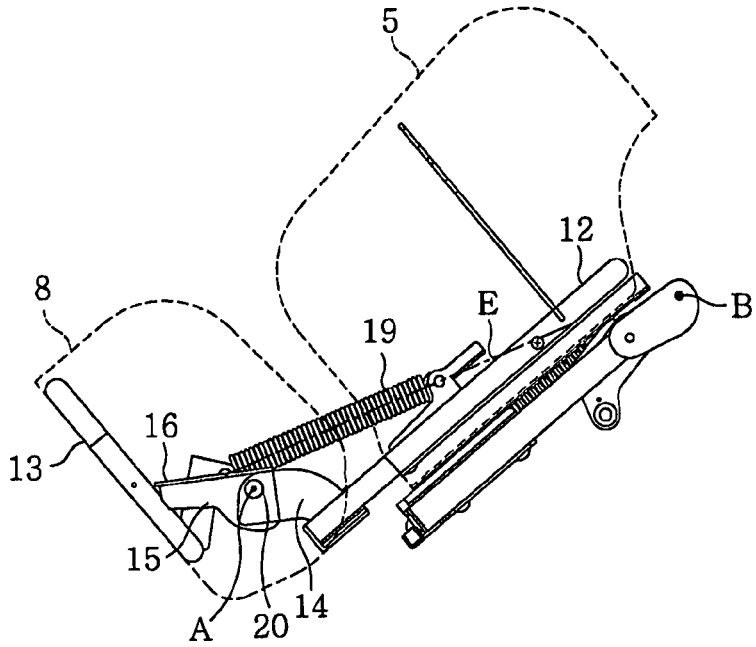

In other words, when the leading side of the footrest 8 is pivotally moved to the uppermost position so that the feet supporting surfaces 8*a* and the calves supporting surfaces 5*a* are substantially perpendicular to each other as shown in FIG. 4A, the tensile axis E of the biasing spring 19 is positioned above the pivot axis A when seen from the side, and the biasing force is applied in the direction of pulling the leading side of the footrest 8 upward. At this time, if the user presses the footrest 8 with the tiptoes to pivotally move the footrest 8 downward with respect to the leg rest 5, the tensile axis E of the biasing spring 19 approaches the pivot axis A, and the biasing force applied in the pivotal movement direction decreases.

The biasing force applied in the pivotal movement direction becomes zero at the point where the tensile axis E of the biasing spring 19 crosses the pivot axis A. Moreover, if the footrest 8 is further pivotally moved downward, the tensile axis E of the biasing spring 19 is positioned below the pivot axis A. At this time, the direction of the biasing force applied by the biasing spring 19 is reversed, thereby pulling the leading side of the footrest 8 downward. The downward biasing force increases as the footrest 8 is pivotally moved downward. However, due to the contact of the stopper piece 16 with the second contacting surface 14*b* of the leg-side connecting member 14, the position of the footrest 8 is maintained in a state where the feet supporting surfaces 8*a* and the calves supporting surfaces 5*a* are substantially parallel to each other, as described in FIG. 4B.

Figure 4B:
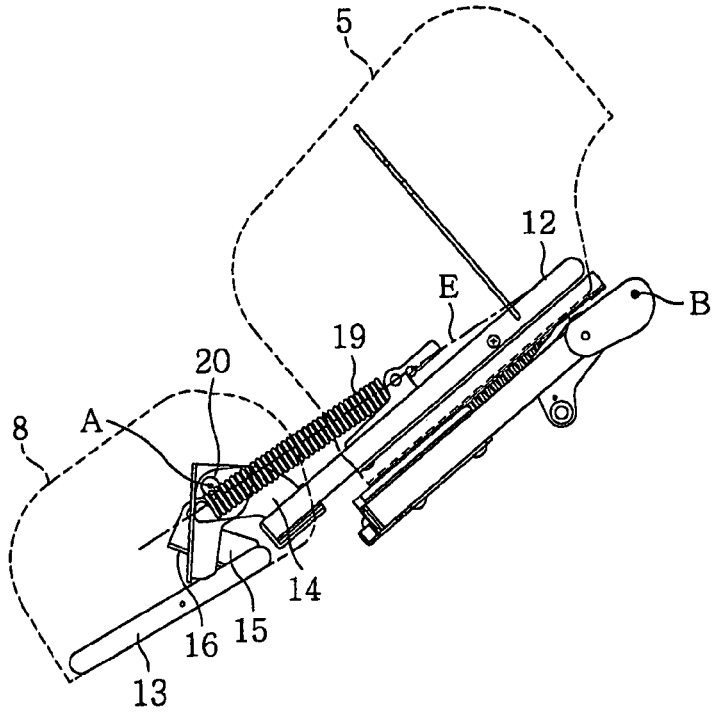

Accordingly, when the massage is performed on a range from heels to calves while maintaining the position of the footrest 8 as shown in FIG. 4B, the biasing force of pivotally moving the footrest 8 upward is not applied to the footrest 8. As a consequence, the user's ankles are not pressed, and the user can feel comfortable. For convenience, a self-weight of the footrest 8 or the like is not considered in the specification. However, the direction of the biasing force in the pivotal movement direction is reversed at a specific angle determined by considering the self-weight.

Figure 5:
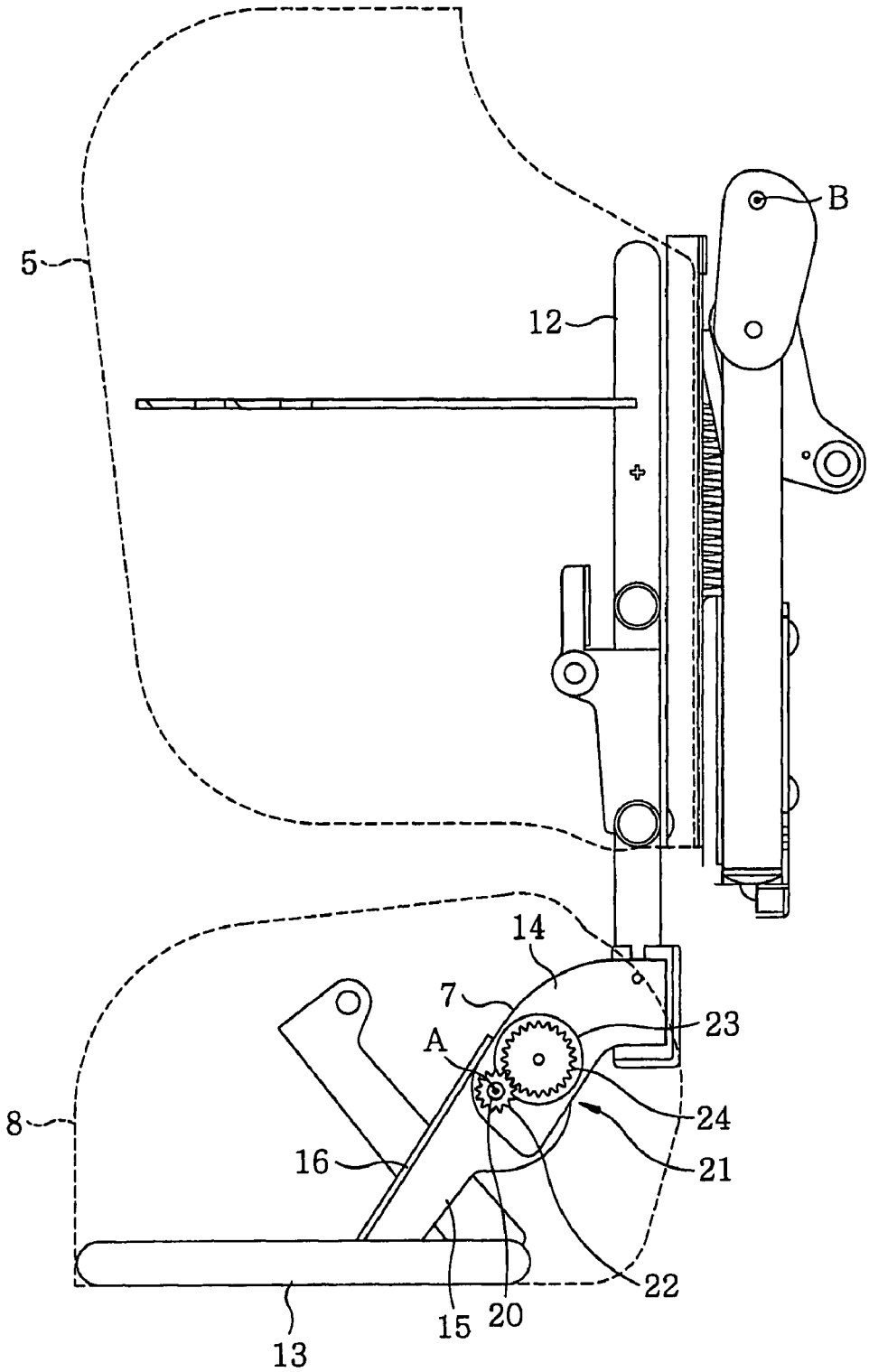
FIG. 5 offers a side view of an inner structure of principal parts of a chair-type massage machine in accordance with a third embodiment of the present invention.

Hereinafter, a chair-type massage machine in accordance with a third embodiment of the present invention will be described with reference to FIG. 5. A description of the same configuration as that in the first embodiment will be omitted, and features of the third embodiment will be explained in detail hereinafter. The illustration of the biasing spring 19 is omitted in FIG. 5.

In the third embodiment, there is provided a damping mechanism 21 for restricting a speed of a pivotal movement of the footrest 8 with respect to the leg rest 5. The damping mechanism 21 is installed at the connecting support 7, and includes a spur gear 22 fixed coaxially with that of the shaft member 20 pivotally moving as a unit with the leg-side connecting member 14, a rotary damper 23 installed at the foot-side connecting member 15, and a spur gear 24 attached to a shaft of the rotary damper 23 and also engaged with the spur gear 22. The rotary damper 23 applies a load acting in the opposite direction to the pivotal movement of the shaft thereof by viscosity or friction of liquid sealed therein. Instead of the rotary damper 23 for applying the load to the pivotal movement, there can be used a device for applying a load to a linear movement or a device using resistance other than the viscosity or friction of liquid.

Due to the presence of the damping mechanism 21, it is possible to reduce noise and vibration generated when the pivotal movement of the footrest 8 is stopped by the stopper piece 16. Especially, by restricting the speed of the pivotal movement in the direction of pushing downward the leading side of the footrest 8, the user standing on the footrest 8 can be prevented from falling down due to sudden movement of the footrest 8.

Figure 6:
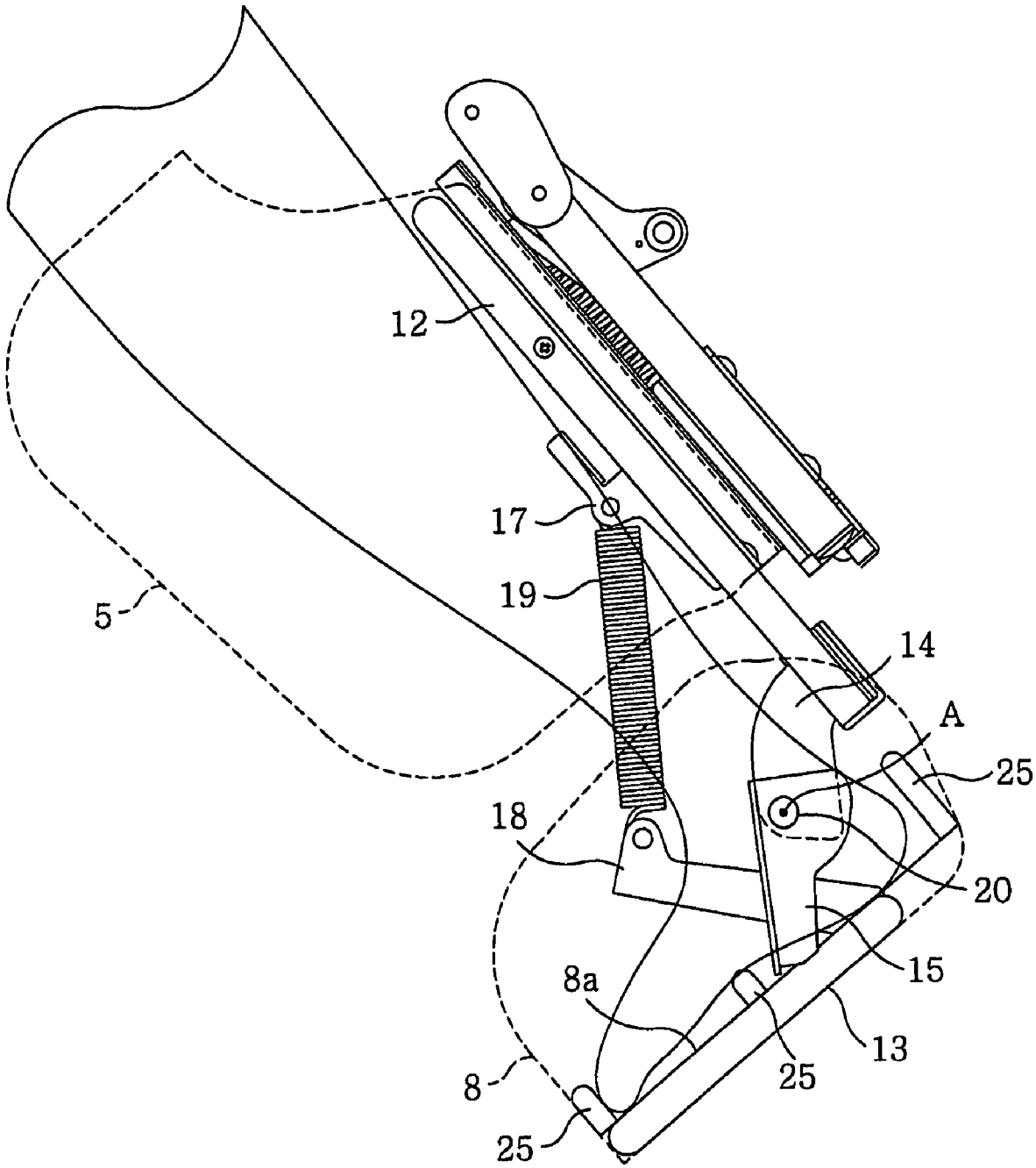
FIG. 6 is a side view of an inner structure of principal parts of a chair-type massage machine in accordance with a fourth embodiment of the present invention.

Hereinafter, a chair-type massage machine in accordance with a fourth embodiment of the present invention will be described with reference to FIG. 6. A description of the same configuration as that in the first embodiment will be omitted, and features of the fourth embodiment will be explained in detail hereinafter. In the fourth embodiment, the pivot axis A extending between the shaft members 20 of the right and left connecting supports 7 for pivotally connecting the footrest 8 with the leg rest 5 is positioned to face the feet supporting surfaces 8*a* of the footrest 8 (i.e., vertically above the feet supporting surfaces 8*a*).

As illustrated, the pivot axis A is set to be positioned substantially on an axis extending between ankle joints of a user who puts his/her soles on the feet supporting surfaces 8*a* of the footrest 8. In general, an ankle joint is located at about ¼ of a length from a heel to a toe and at a height of about 60 mm to about 80 mm from a sole. By positioning the pivot axis A at the above range, the soles are kept in place on the feet supporting surfaces 8*a* even when the footrest 8 is pivotally moved, thereby allowing the user to feel comfortable in manipulating the footrest 8. Further, the massage position is kept unchanged, so that the effective massage can be performed.

The pivot axis A is positioned vertically above the feet supporting surfaces 8*a* while facing it, so that the footrest 8 can be pivotally moved even in a case when the biasing spring 19 is not provided. In other words, when a user presses the footrest 8 with the toes while putting the soles on the feet supporting surfaces 8*a*, the footrest 8 is pivotally moved downward about the pivot axis A. On the other hand, when the user presses the footrest 8 with the heels, the footrest 8 is pivotally moved upward about the pivot axis A. As a result, it is possible to provide a low cost structure having no biasing spring 19.

Provided on the footrest 8 are protrusions 25 serving as a positioning unit for determining a position of feet of user on the footrest 8. The protrusions 25 include those for contacting with front portions of feet, those for contacting arches of soles and those for contacting rear portions of heels. In addition, protrusions can be provided for contacting other portions of the feet, e.g., portions between toes, side portions of the feet, top portions of the feet or the like. The installation areas of the protrusions 25 are not limited to the feet supporting surfaces

8*a* and can be extended to other portions such as side surfaces of the recess portions 10 and the like. Or, the protrusions 25 may be provided at a stuffed product for covering the footrest 8. Moreover, the protrusions 25 can be replaced by a visual positioning unit such as a mark or the like. Due to the presence of the positioning unit, when a user puts his/her soles on the feet supporting surfaces 8*a* of the footrest 8, the user can position the feet properly. Since the ankle joints of the user and the pivot axis A of the footrest 8 can be kept in a stable positional relationship, the user can pivotally move the footrest 8 in a stable manner.

Hereinafter, a chair-type massage machine in accordance with a fifth embodiment of the present invention will be described with reference to FIGS. 7A and 7B. A description of the same configuration as that in the first embodiment will be omitted, and features of the fifth embodiment will be explained in detail hereinafter. The illustration of the biasing spring 19 is omitted in FIGS. 7A and 7B.

Figure 7A:
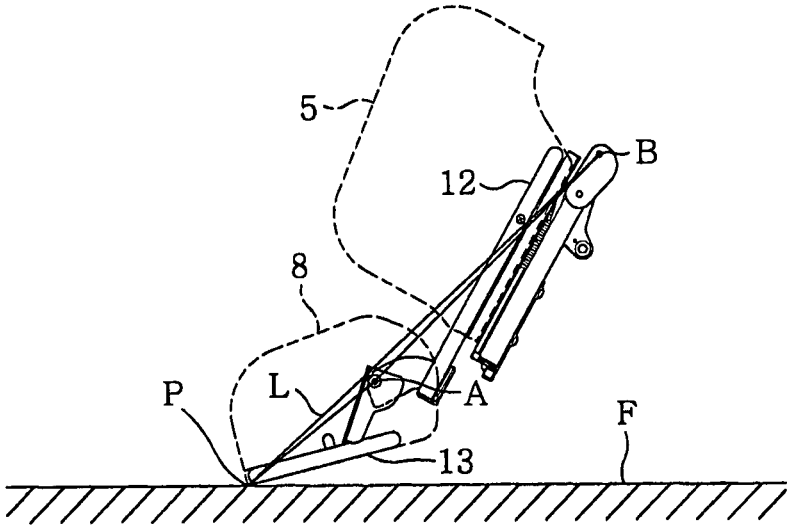
Figure 7B:
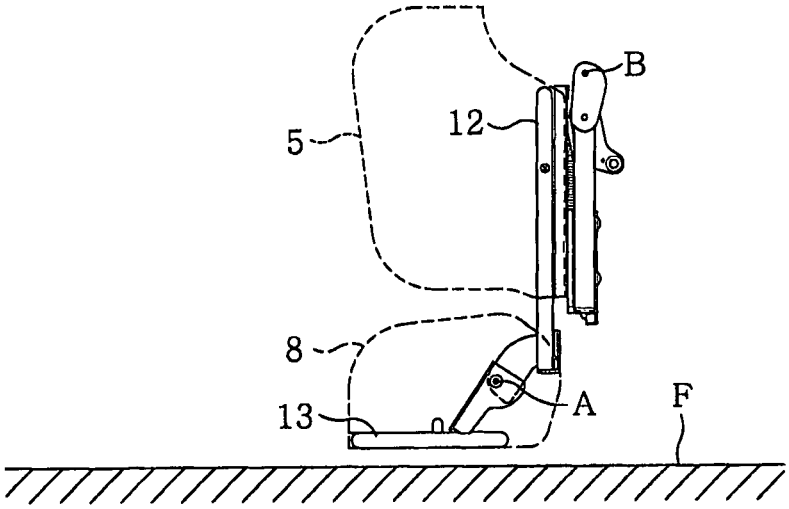

FIG. 7A shows a state in which the leading side of the footrest 8 is pivotally moved downward to the maximum degree (i.e., the lowermost position) within a pivotal movement range thereof so as to contact with the bottom surface F. In this embodiment, when seen from the side as in FIGS. 7A and 7B, the pivot axis A about which the footrest 8 is pivotally moved with respect to the leg rest 5 is positioned lower than a straight line L connecting a contact point P of the footrest 8 with the bottom surface F and a pivot axis B about which the leg rest 5 is pivotally moved with respect to the seat 1. The pivot axis B is a horizontal axis extending along the center line of the support bar 4.

While the leg rest 5 is pivotally moved downward in a state where the footrest 8 has been pivotally moved to the lowermost position, reaction force from the bottom surface F makes the footrest 8 is pivotally moved upward with respect to the leg rest 5 if the leg rest 5 is further pivotally moved downward from a state where the leading end of the footrest 8 contacts with the bottom surface F. As the leg rest 5 is further pivotally moved downward, the footrest 8 is pivotally moved to be substantially in parallel with the bottom surface F. When the leg rest 5 is located in a substantially vertical position as shown in FIG. 7B, the footrest 8 becomes substantially perpendicular to the leg rest 5. During this, the pivot axis A is always positioned below the straight line L. Here, the bottom surface F is a flat surface.

With the above configuration, when the leg rest 5 is pivotally moved downward, it is possible to prevent the leading end of the footrest 8 from sticking into the bottom surface F, which may results in poor movement or breakdown of the leg rest 5. Moreover, even when the biasing spring 19 is not provided, the footrest 8 can be naturally positioned as shown in FIG. 7B by pivotally moving the leg rest 5 downward. As a result, it is possible to provide a low cost structure having no biasing spring 19.

While the invention has been shown and described with respect to the embodiments, it will be understood by those skilled in the art that various changes and modification may be made without departing from the scope of the invention as defined in the following claims.

What is claimed is:

1. A chair-type massage machine comprising:

a seat on which a user sits;

a leg rest whose one end portion is pivotally connected with a front portion of the seat for pivotal movement up and down, the leg rest supporting calves of the user;

a driving unit for pivotally moving the leg rest with respect to the seat;

a footrest pivotally connected with the other end portion of the leg rest for pivotal movement up and down, the footrest supporting feet of the user;

a massage means provided to at least one of the leg rest and the footrest;

a stopper unit for restricting a range of pivotal movement of the footrest with respect to the leg rest; and biasing unit for applying a biasing force to the footrest in an upward direction of the pivotal movement;

wherein an angle of the footrest with respect to the leg rest is adjustable at least in the downward direction by the foot of the user independently of an angle of the leg rest with respect to the seat and the biasing unit installed between the footrest and the leg rest is positioned above the pivot axis about which the footrest is pivotally moved with respect to the leg rest when seen from a side.

2. The chair-type massage machine of claim 1, wherein the biasing unit reduces the biasing force in the direction of the pivotal movement as the leading side of the footrest is pivotally moved downward with respect to the leg rest.

3. The chair-type massage machine of claim 1, wherein the biasing unit is disposed at a central portion in a width direction of the footrest.

4. The chair-type massage machine of claim 1, further comprising a damping mechanism for restricting a speed of the pivotal movement of the footrest with respect to the leg rest.

5. The chair-type massage machine of claim 1, wherein in a state that the leading side of the footrest is pivotally moved to contact with a bottom surface, a pivot axis about which the footrest is pivotally moved with respect to the leg rest is positioned, when seen from a side, below a straight line connecting a contact point of the footrest with the bottom surface and a pivot axis about which the leg rest is pivotally moved with respect to the seat.

6. The chair-type massage machine of claim 1, wherein a restricted angular range of pivotal movement of the footrest with respect to the leg rest is from 90° to 180°.

7. A chair-type massage machine comprising:

a seat on which a user sits;

a leg rest whose one end portion is pivotally connected with a front portion of the seat for pivotal movement up and down, the leg rest supporting calves of the user;

a driving unit for pivotally moving the leg rest with respect to the seat;

a footrest pivotally connected with the other end portion of the leg rest for pivotal movement up and down, the footrest supporting feet of the user;

a massage means provided to at least one of the leg rest and the footrest;

a stopper unit for restricting a range of the pivotal movement of the footrest with respect to the leg rest; and a biasing unit for applying a biasing force to the footrest in an upward direction of the pivotal movement, wherein a pivot axis about which the footrest is pivotally moved with respect to the leg rest is positioned to face the feet supporting surfaces of the footrest on which soles of the user are put and an angle of the footrest with respect to the leg rest is adjustable at least in the downward direction by the foot of the user independently of an angle of the leg rest with respect to the seat, and wherein the biasing unit installed between the footrest and the leg rest is positioned above the pivot axis about which the footrest is pivotally moved with respect to the leg rest, when seen from a side.

8. The chair-type massage machine of claim 7, wherein the pivot axis is positioned substantially aligned with an axis extending between ankle joints of the user who puts the soles on the feet supporting surfaces.

9. The chair-type massage machine of claim 7, further comprising a positioning unit installed at the footrest for determining position of the user's feet with respect to the footrest.

10. The chair-type massage machine of claim 7, wherein the biasing unit applies the biasing force in a direction of pivotally moving a leading side of the footrest upward.

11. The chair-type massage machine of claim 10, wherein the biasing unit reduces the biasing force in the direction of the pivotal movement as the leading side of the footrest is pivotally moved downward with respect to the leg rest.

12. The chair-type massage machine of claim 7, wherein the biasing unit is disposed at a central portion in a width direction of the footrest.

13. The chair-type massage machine of claim 7, further comprising a damping mechanism for restricting a speed of the pivotal movement of the footrest with respect to the leg rest.

14. The chair-type massage machine of claim 7, wherein in a state that a leading side of the footrest is pivotally moved to contact with a bottom surface, a pivot axis about which the footrest is pivotally moved with respect to the leg rest is positioned, when seen from a side, below a straight line connecting a contact point of the footrest with the bottom surface and a pivot axis about which the leg rest is pivotally moved with respect to the seat.

15. The chair-type massage machine of claim 7, wherein a restricted angular range of pivotal movement of the footrest with respect to the leg rest is from 90° to 180°.

* * * * *